United States Patent [19]

Hiemstra

[11] 4,319,680

[45] Mar. 16, 1982

[54] PACKAGING

[75] Inventor: Christiaan K. Hiemstra, Amsterdam, Netherlands

[73] Assignee: Hiemstra Evolux B.V., Haarlem, Netherlands

[21] Appl. No.: 224,903

[22] Filed: Jan. 14, 1981

[30] Foreign Application Priority Data

Feb. 1, 1980 [GB] United Kingdom ..... 03536/80

[51] Int. Cl.[3] ..... B65D 85/62; B65D 5/06

[52] U.S. Cl. ..... 206/45.14; 206/434; 206/499; 229/15; 229/40

[58] Field of Search ..... 206/45, 14, 491, 434, 206/503, 499, 454; 229/15, 40

[56] References Cited

U.S. PATENT DOCUMENTS

| | | | |
|---|---|---|---|
| 1,857,033 | 5/1932 | Sherman | 229/15 |
| 2,709,033 | 5/1955 | Ritchie | 206/503 |
| 3,005,546 | 10/1961 | Sanford | 206/434 |
| 3,313,407 | 4/1967 | Palm, Jr. | 206/491 |
| 3,411,696 | 11/1968 | Ayer et al. | 206/491 |
| 3,454,157 | 7/1969 | Kulig | 206/454 |

*Primary Examiner*—William T. Dixson, Jr.

*Attorney, Agent, or Firm*—Watson, Cole, Grindle & Watson

[57] ABSTRACT

A package comprising an outer carton housing a plurality of display packs, such as blister packs, each comprising an essentially planar support card. The carton is formed as a sleeve open at both ends and the packs are disposed in spaced parallel relation within the sleeve, and transversely to its side walls, and are held in desired positions within the sleeve by engagement with their respective support cards of flaps integral with the carton and turned inwardly, the flaps having free edges parallel with the support cards. Thereby obviating the need for separate spacers inside the carton.

6 Claims, 5 Drawing Figures

PACKAGING

This invention relates to packaging and more particularly to the packaging in a protective outer carton of a plurality of display packs such as blister packs and other packs in which merchandise is supported on or by a card so as to be visible from one or both sides of the card.

The term blister pack is used herein to denote a pack comprising a support card to which is secured a blister part usually of transparent or translucent material shaped to define a housing in which an article or articles of merchandise is or are housed. Usually, the support card is generally planar and the pack may be single-sided, in which case the blister part projects to one side only of the card, or double sided in which case the blister part projects to both sides of the card. In the latter case the blister part may be made up of two blister members separately formed and secured to the card and co-operating to define a single housing for the merchandise.

It is possible in many cases to load groups of blister packs or other display packs into a simple cardboard carton stacked side-by-side or one on top of another, but if the contents are relatively heavy or delicate it may be necessary to hold the packs away from each other by means of separate spacers between adjacent packs or pairs of packs.

The present invention provides a package of a plurality of display packs which is of relatively cheap and simple construction but provides for secure location of the packs to prevent them resting or impinging on each other during storage, transit display and dispensing.

In accordance with a feature of the invention there is provided a package comprising a plurality of display packs housed within an outer carton formed as a sleeve open at both ends, the display packs each comprising a support card having planar marginal portions, and wherein the display packs are arranged with their support cards extending transversely of the sleeve and are held in desired positions within the carton by flaps integral with the carton and turned inwardly of the carton to support the said marginal portions from both sides.

With this construction, the individual display packs are protected against impinging on each other in transit, and the cartons, being open at their ends, permit viewing of the respective packs adjacent the ends of the cartons, as well as reducing material costs in carton manufacture, compared with conventional cartons which are completely closed at their ends.

Preferably, retaining flaps are formed at both open ends of the sleeve by turning in marginal end portions of the carton so as to engage packs adjacent the respective ends of the carton. This results not only in a convenient way of forming retaining flaps at the ends of the carton, but also in mechanical reinforcement of the end portions of the carton against possible impacts during transit.

Further flaps turned in from side walls of the carton act as spacers between display packs within the carton and also serve to retain packs remaining in the carton when the flaps at one end of the carton have been turned out to permit removal of the display pack or packs adjacent that end.

Some forms of packaging in accordance with the invention will now be described with reference to the accompanying drawings, in which.

Figure 1:
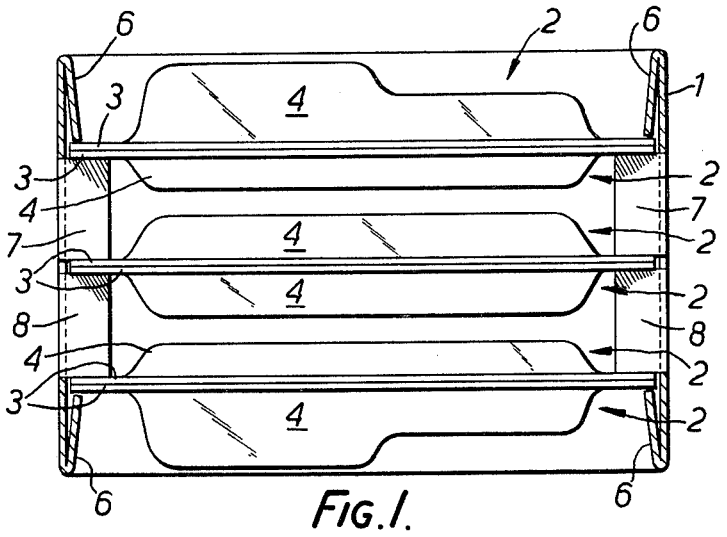
FIG. 1 is a part sectional side elevation of one form of package.
Figure 2:
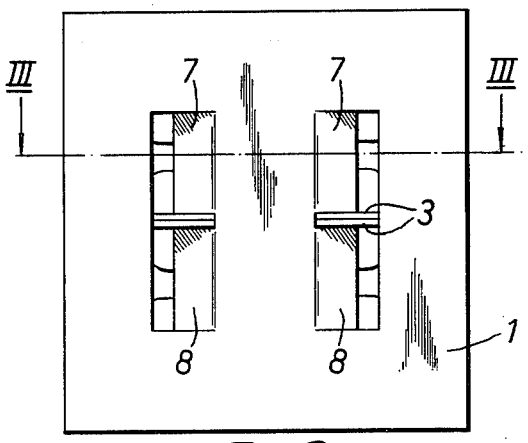
FIG. 2 is an end view of the package of FIG. 1.
Figure 3:
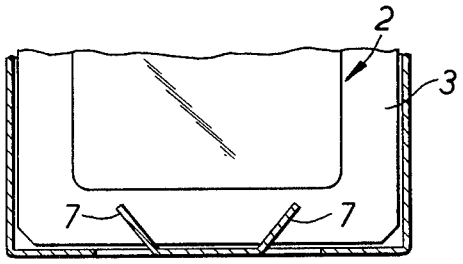
FIG. 3 is a scrap section on the line III—III of FIG. 2.

The package shown in FIGS. 1 to 3 comprises an outer carton 1 in the form of an open ended sleeve of rectangular cross-section, to suit the profile of the blister packs 2 which it houses. Each pack comprises a flat support card 3 having secured to one face a blister part 4. The packs have planar marginal portions along all four sides to facilitate their location and support within the carton.

As shown in FIG. 1, the packs are arranged in pairs with their plane rear surfaces lying face-to-face.

The carton has various integral flaps by which the respective pairs of packs are located between the ends of the sleeve. Four flaps 6 are formed at the ends of the carton by turning in the marginal edge portions of the carton on all four sides. The narrow edges of the flaps are cut to have interlocking engagement with each other at the corners of the carton and thus to hold themselves against springing out.

Thus, the flaps 6 at the upper end of the carton, as viewed in FIG. 1, bear down on the planar marginal portions of the uppermost blister pack while the flaps 6 at the lower end support the margins of the lowermost blister pack.

Intermediate its top and bottom edges, each of the narrower side walls of the carton is formed with two pairs of integral flaps 7,7 and 8,8 which are turned in about vertical fold lines, so that their upper and lower horizontal edges engage and support the adjacent marginal portions of respective packs, which are thus all firmly located in predetermined positions between the ends of the carton.

A convenient way to load the carton is to turn in only the lower set of flaps 6, then load in the first (lowermost) pair of packs, then turn in the flaps 8, then load the second packs, then turn in the flaps 7, then turn down the upper edge flaps 6, and then load the uppermost pair of packs, forcing them past the flaps 6, which spring back to overlie the upper surface of the uppermost card to secure the last pair of packs.

Since the ends of the carton are open, the packs closest to the ends are exposed for view, and a further convenience of the package is that the holes left by turning in the flaps 7 and 8 form finger holes by which the packages can be carried.

Figure 4:
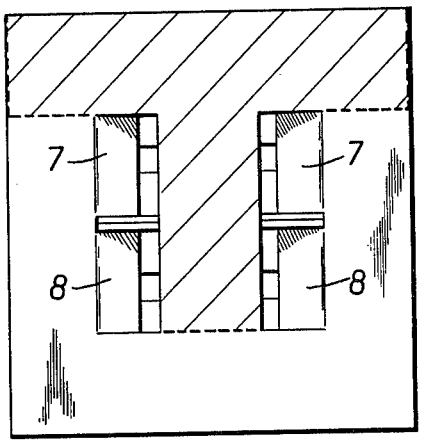
FIG. 4 is an end view, corresponding to FIG. 2 illustrating a modification.

In the modified form of package illustrated in FIG. 4, the outer sleeve has one side wall (at each of a pair of opposed side walls) provided with T-shaped panel, lightly shaded in the figure and bounded by lines of weakness, such as perforations, which enable the panel to be removed to facilitate use of the package as a dispenser. It will be noted that the flaps 7 and 8 are hinged about fold lines at their outer edges so that the flaps are left in place when the panel is torn away. Individual packs can then be slid out of the upper end of the carton sleeve.

Figure 5:
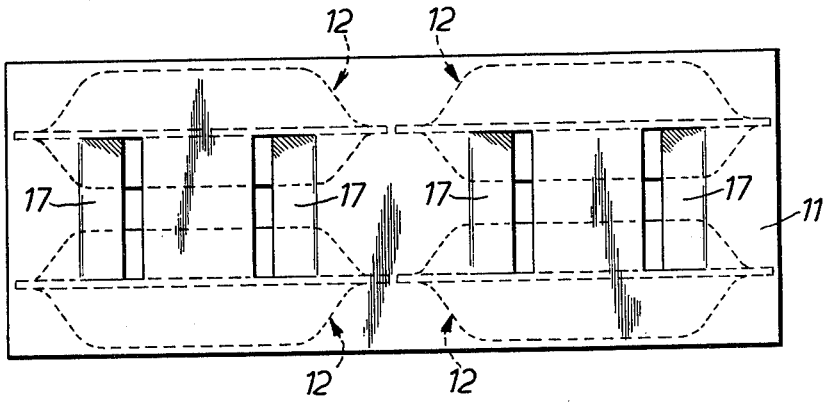
FIG. 5 is an end elevation of the second form of package.

FIG. 5 illustrates an alternative form of package particularly suited to double-sided blister packs.

The outer carton 11 is generally similar to that described above but each of a pair of opposed side walls has two pairs of flaps 17 at the same level, either to suit very large blister packs or, as illustrated, to allow two packs 12 to be accommodated side by side. The package illustrated thus includes four double-sided blister packs arranged in two layers. Each pack is supported on the one hand by horizontal end edges of the flaps 17 and on the other hand by the inturned end edges of the carton.

It will be readily understood that further layers of blister packs could be accommodated by forming a deeper sleeve with further sets of flaps 7.

In each of the illustrated embodiments it is sufficient to provide flaps 7,8 and 17 in two side walls only of the carton, but if more support were required because of the size or weight of the blister packs, corresponding flaps could be provided in the other side walls.

In each of the above described packs the flaps 7 and 8 or 17 are positioned and dimensioned to make good frictional engagement with the packs, to guard against their springing out. Alternatively the flaps may be designed to make interlocking engagement with cooperating portions of the packs.

The flaps 7,8 or 17 can also be arranged to fold in about horizontal fold lines.

With packages of the above described forms it will be seen that the endmost packs are displayed through the open ends of the carton while being held firmly in their desired locations, but that the remaining packs are held in position even after the end flaps 6 at one end of the carton are folded out and the display pack or packs at that end have been removed.

The invention is described above with reference to blister packs but is equally applicable to other display packs, e.g. in which the merchandise is merely mounted on a support or engaged in an aperture in the support card, or e.g. in which the merchandise and the card are enclosed in heat-shrink film.

I claim:

1. A package comprising an outer carton formed as a one-piece sleeve having opposed open ends, and a plurality of display packs housed within said sleeve, each said display pack comprising a support card having planar marginal portions and means for supporting at least one item of merchandise within said marginal portions, said display packs each located within said sleeve with its support card extending transversely thereof and said carton comprising flap means integral with said carton and turned inwardly thereof to have supporting engagement with said marginal portions whereby to retain said packs in desired locations intermediate said ends of said sleeve.

2. A package according to claim 1, wherein at least one said display pack is supported from one side by a free edge of one said means turned in about a fold line parallel with the plane of the support card of the pack, and from the other side by an edge of a further one of said flap means turned in from a side wall of said sleeve.

3. A package according to claim 1 wherein at least one said display pack is supported from both sides by adjacent spaced edges of respective flap means turned in about fold lines perpendicular to the plane of the support card of the pack.

4. A package according to claim 2 in which a pair of single sided blister packs located with their support cards face-to-face are supported as a pair by respective said flap means.

5. A package according to claim 1 wherein said outer carton comprises marginal end portions turned in at both open ends of the carton, said portions constituting respective flap means which engage separate packs adjacent respective said ends of said sleeve, said packs being held spaced apart within said carton by further flap means turned inwardly from side walls of said carton, intermediate said ends thereof.

6. A package comprising an outer carton and a plurality of display packs housed within said carton; each said pack comprising an essentially planar support card and means associated with said card for retaining an item of merchandise to said card, said item being positioned medially of said card, said card having a peripheral border portion extending there around; said carton comprising a sleeve having side walls and opposed open ends, said packs being positioned in said carton with respective said support cards extending parallel with each other and transversely to said side walls;

said carton comprising end flap means comprising marginal end portions of said side walls turned inwardly of said sleeve and having free end edges directed towards an opposite said end of said sleeve;

said carton further comprising intermediate flap means integral with said side walls and turned inwardly therefrom, said intermediate flap means includes free edges extending transversely to said side walls; and wherein said packs are located in desired positions by supportive engagement with said free edges of respective said flap means.

* * * * *